US008375537B2

(12) United States Patent
Liu et al.

(10) Patent No.: US 8,375,537 B2
(45) Date of Patent: Feb. 19, 2013

(54) PROCESS FOR MANUFACTURING SUPER-HIGH-COUNT RAMIE FABRIC AND THE FABRIC

(75) Inventors: Zheng Liu, Zhuzhou (CN); Hao Geng, Zhuzhou (CN); Xiangqi Zhou, Zhuzhou (CN); Liming Liu, Zhuzhou (CN)

(73) Assignee: Hunan Huasheng Zhuzhou Cedar Co., Ltd., Hunan (CN)

( * ) Notice: Subject to any disclaimer, the term of this patent is extended or adjusted under 35 U.S.C. 154(b) by 254 days.

(21) Appl. No.: 12/601,921

(22) PCT Filed: Jun. 18, 2008

(86) PCT No.: PCT/CN2008/071340

§ 371 (c)(1), (2), (4) Date: Nov. 25, 2009

(87) PCT Pub. No.: WO2008/154866

PCT Pub. Date: Dec. 24, 2008

(65) Prior Publication Data

US 2010/0300576 A1 Dec. 2, 2010

(30) Foreign Application Priority Data

Jun. 18, 2007 (CN) ..... 2007 1 0035172

(51) Int. Cl.
*D03D 15/00* (2006.01)
*D06B 1/00* (2006.01)
*D06C 27/00* (2006.01)

(52) U.S. Cl. ..... 28/168; 28/165; 28/167; 28/169

(58) Field of Classification Search ..... 28/168, 28/165, 166, 167, 169, 178; 139/36, 291 R, 139/420 R, 424, 420 A, 426 R, 35; 8/115.51, 8/115.6, 495, 116.1; 57/7, 295
See application file for complete search history.

(56) References Cited

U.S. PATENT DOCUMENTS

| | | | | |
|---|---|---|---|---|
| 2,639,988 | A * | 5/1953 | Zeehuisen | 162/20 |
| 3,632,391 | A * | 1/1972 | Whitfield et al. | 442/63 |
| 4,617,383 | A * | 10/1986 | Jaskowski | 536/2 |
| 5,455,114 | A * | 10/1995 | Ohmory et al. | 428/364 |
| 5,577,307 | A * | 11/1996 | Itoi | 28/168 |
| 2002/0133924 | A1 * | 9/2002 | Cohen et al. | 28/168 |
| 2003/0192157 | A1 * | 10/2003 | Andrews | 28/170 |
| 2007/0094810 | A1 * | 5/2007 | Xu | 8/115.51 |
| 2007/0243596 | A1 * | 10/2007 | Liu et al. | 435/209 |
| 2009/0286302 | A1 * | 11/2009 | Liu et al. | 435/202 |
| 2009/0317893 | A1 * | 12/2009 | Liu et al. | 435/263 |
| 2011/0192488 | A1 * | 8/2011 | Sun | 139/25 |

FOREIGN PATENT DOCUMENTS

| | | |
|---|---|---|
| CN | 1038847 A | 1/1990 |
| CN | 1136099 | 11/1996 |
| CN | 1609299 | 4/2005 |
| CN | 101070656 | 11/2007 |

OTHER PUBLICATIONS

Xu, Guanqun et al., The manufacture of drawnwork fabric from water-soluble vinylon and polyester, Guangxi Textile Technology, Sep. 1996, vol. 17, No. 5, pp. 6-9, ISSN GXFZ.0.

Yang, Miso et al., The development of high count pure ramie yarn fabric. Sichuan Textile Technology, Aug. 2002, No. 4, pp. 34-35, ISSN: 1008-0643.0.

Junxia, Dong, Practice for Weaving Ramie/Water-Soluble Vinylon Fabric, HenanAnyang Delong Textile Co., Ltd., Cotton Textile Technology, Sep. 2009, pp. 565-567.

Yanqun, Zhou et al., Development of High-Count Pure Ramie Sheer Product, Mengyin Cotton Mill, pp. 34-36.

Bin, Shi et al., Spinning CJ/V 7.3 Tex Yarn with Water-Soluble Vinylon, Shandong Jining Yinghua Textile Group, Cotton Textile Technology, Mar. 2001, pp. 173-174.

Miao, Yang et al., Development of High-Count Thin-Type Pure Ramie Sheer Fabric, Hunan Zhuzhou Ramie Textile and Dyeing Plant, National Information Center of Ramie Textile, Apr. 2002, pp. 34-35.

* cited by examiner

*Primary Examiner* — Amy Vanatta
(74) *Attorney, Agent, or Firm* — Boyle Fredrickson, S.C.

(57) ABSTRACT

The present invention relates to a process for manufacturing a ramie fabric and the fabric. The process comprising the following steps: blend spinning a high-count ramie fiber such as a ramie fiber of $2500^{Nm}$ or higher with a water-soluble fiber as carrier to form a yarn; sizing the yarn at a low temperature; weaving the yarn to form a gray fabric; then removing the water-soluble fiber from the gray fabric by deweighting the gray fabric during a printing and dyeing finishing process to obtain a super-high-count ramie fabric with a ramie yarn fineness of $160^{Nm}$ or higher.

18 Claims, No Drawings

PROCESS FOR MANUFACTURING SUPER-HIGH-COUNT RAMIE FABRIC AND THE FABRIC

THE FIELD OF THE INVENTION

The present invention relates to a process for manufacturing a ramie fabric and the ramie fabric, in particular, to a super-high-count ramie fabric having a yarn fineness of higher than $160^{Nm}$ (metric count), and especially to a process for manufacturing a super-high-count ramie fabric and the ramie fabric.

BACKGROUND OF THE INVENTION

Ramie is a unique plant resource in China, and the gross output of ramie in China occupies 90% of that of the world. Ramie fiber has the advantageous features of strong hydroscopicity, fast heat dissipation, corrosion resistance and bacterial inhibition, soft luster, recyclability, environmental friendliness and the like, as well as excellent wearability. Most of the ramie fabrics are of rough and natural style and have a yarn count of not higher than $36^{Nm}$, and it is difficult to produce a ramie fabric of higher than $60^{Nm}$ by a conventional process due to low production efficiency and poor stability of product quality. Therefore, it is urgent to solve the problems existing in the development of ramie products with high added value, especially pure thin super-high-count ramie products, and the improvement of the quality of ramie products; and it is necessary to make an all round and systematic research thereon.

SUMMARY OF THE INVENTION

One embodiment of the present invention provides a process for manufacturing a super-high-count ramie fabric, especially a pure ramie fabric, the process comprising the following steps: blend spinning a high-count ramie fiber such as a ramie fiber of about $2500^{Nm}$ or higher with a water-soluble fiber as carrier to form a yarn; sizing the yarn at a low temperature; weaving the yarn to form a gray fabric; then removing the water-soluble fiber from the gray fabric by deweighting the gray fabric during a printing and dyeing finishing process to obtain a super-high-count ramie fabric with a ramie yarn fineness of about $160^{Nm}$ or higher.

In one embodiment, the soluble fiber is about $6000^{Nm}$ or higher, preferably from about $6000^{Nm}$ to about $8000^{Nm}$.

The water-soluble fiber used in the present invention is not particularly restricted, and can be one or more of the water-soluble fibers selected from poly(vinyl alcohol) fiber (vinylon), alginate fiber, carboxymethyl cellulose fiber and the like, preferably a water-soluble fiber with a water-soluble temperature of below about 95° C., more preferably a water-soluble fiber with a water-soluble temperature of about 80° C. to about 95° C. such as unacetalized vinylon.

The "blend spinning" used in the present invention is also known as "carrier spinning" or "matrix spinning", particularly refers to a technique in which one or more water-soluble fibers are used as a carrier and blend spun with a ramie fiber to form a yarn and then the water-soluble fibers are removed by dissolution in a printing and dyeing finishing process to leave the ramie fiber only.

In one embodiment, the step of blend spinning the ramie fiber with the water-soluble fibers as carrier comprises subjecting the ramie fiber and the water-soluble fibers to the steps of pre-drawing, drawing, roving, and spinning, etc. to form a blended yarn of the ramie fiber and the water-soluble fibers.

In one embodiment, the dry-weight blended ratio of the ramie fibers to the water-soluble fibers in the blended yarn is about 20-70: about 80-30, preferably about 30-60: about 70-40, more preferably about 30-50: about 70-50. In other words, the content of the ramie fibers in the blended yarn is about 20-70 wt %, preferably about 30-60 wt %, more preferably about 30-50 wt % based on the dry weight of the blended yarn, and the content of the water-soluble fibers in the blended yarn is about 80-30 wt %, preferably about 70-40 wt %, more preferably about 70-50 wt % based on the dry weight of the blended yarn.

In one preferred embodiment, the step of drawing is performed by drawing the pre-drawn water-soluble fibers and the pre-drawn ramie fiber for 4 times or more, using a drawing process with 4 or more routes, and adopting a total draft ratio of about 8-10.

In another preferred embodiment, the step of roving is performed by using a roving process with two routes and adopting a total draft ratio of about 7-9.5.

In still another preferred embodiment, the spinning step has a total draft ratio of about 10-40, a twist factor of about 100-130, and a twist degree of about 800-1200 twist/meter.

In one embodiment, the step of weaving to form the gray fabric comprises: winding the blended yarn of the ramie fiber and the water-soluble fiber to obtain a large bobbin yarn by using a winding equipment with an air splicer and an electronic yarn clearer, then beam-warping, sizing at a low temperature, and weaving to obtain a blended gray fabric of the ramie fiber and the water-soluble fibers meeting the requirements of process design.

In the present invention, the step of sizing at a low temperature can be performed at a temperature lower than a conventional sizing temperature, for example at a temperature of 95° C. or lower, especially 80° C. or lower, because the sizing temperature should not exceed the dissolving temperature of the water-soluble fiber(s), otherwise the water-soluble fiber(s) would be partially or fully removed by dissolution.

Furthermore, the sizing solution used in the step of sizing at low temperature in the present invention comprises polyvinyl alcohol (PVA), modified starch, and acrylic sizing agent, and especially is a sizing solution comprising PVA of 5-20 g/L, composite multicomponent-modified starch (for example K-2000) of 10-25 g/L, oxidized starch (for example D-150A) of 30-40 g/L, and acrylic sizing agent (for example LMA-2050) of 1-8 g/L.

Therefore, the step of sizing at low temperature in the present invention is a sizing process adopting "small tensile force, low viscosity, moderate pressure, and slow speed", in which the tensile force, viscosity, pressure and speed can be determined according to desired requirements by those skilled in the art through simple experiments based on the aforesaid temperature and sizing solution.

In comparison with conventional sizing techniques, the step of sizing at low temperature in the above embodiment enable the sized blended yarn to have improved cohesion force of fibers, yarn strength and bundling performance, as well as higher weavability, and significantly reduced flaws and broken ends.

In one embodiment, the printing and dyeing finishing process comprises turning and sewing up, singeing, deweighting, bleaching, whitening, softening, stentering and winding.

In the deweighting step, the sizing solution and water-soluble fiber were thoroughly removed. Preferably, the deweighting step comprises thoroughly removing the water-soluble fiber and the sizing solution in the gray yarn by using alkali desizing and scouring solution in a jet-overflow dyeing machine. In a particular embodiment, the deweighting step comprises placing the singed fabric in the jet-overflow dyeing machine, elevating the temperature to 110-120° C., keeping the temperature for 15-20 minutes, washing the fabric in a bath of alkali desizing and scouring solution, washing twice with hot water having a temperature of 90° C. or higher, each for 10 minutes, washing with cold water once, and discharging the fabric.

In a specific embodiment, the alkali sizing and scouring solution is prepared by adding 1-5 g/L NaOH, 0.2-1.5 g/L sodium carbonate, 1-5 g/L sodium sulfite, 0.2-1.5 g/L non-ion surfactant Peregal-O to clear water, in relative to per liter of clear water.

In one embodiment, the bath ratio of the alkali sizing and scouring solution is 1:20.

In the present invention, the steps of turning and sewing up, singeing, deweighting, bleaching, whitening, softening, stentering, and winding are not particularly limited, as long as they can realize the purpose of the present invention. These steps can also be identical to those adopted in conventional printing and dyeing finishing process, and if necessary, these steps can also be modified by those skilled in the art.

It should be understood that although several specific steps in the manufacturing process of the present invention are described above in details, the manufacturing process of the present invention should not be considered as including the aforesaid steps only. To the contrary, if necessary, the addition, modification or deletion of steps could be conducted by those skilled in the art in order to achieve better effects of the present invention, and these could be achieved by those skilled in the art through limited routine experiments and would not depart from the spirit and scope of the present invention.

Therefore, more specifically, the manufacturing process of the present invention can comprise the following steps:

Predrawing the ramie fiber and the water-soluble fiber→drawing→roving→spinning→winding→warping→sizing→weaving→finishing gray fabric→turning and sewing up→singeing→deweighting→bleaching→drying→softening and whitening→stentering and setting→preshrinking→rolling.

In some embodiments of the present invention, the above blended yarn can be blended with one or more additional non-water-soluble fibers, and woven into gray fabric according to the above process. The water-soluble fiber was then removed in a finishing step to obtain a blended fabric of ramie fiber and one or more additional non-water-soluble fibers, in which the ramie fiber has a fineness of $160^{Nm}$ or higher. The additional non-water-soluble fibers can be any of fibers useful for weaving fabrics in the art, including natural fibers and synthetic fibers, wherein the examples of natural fibers include cotton fiber, hemp fiber, wool fiber, silk fiber and the like, and the examples of synthetic fibers include viscose fiber, terylene fiber, polyamide fiber, acrylic fiber, urethane elastic fiber, polypropylene fiber, vinylon fiber, aramid fiber and the like. The specifications of the additional non-water-soluble fibers are not particularly restricted and, if necessary, can be determined by those skilled in the art through routine experiments. In addition, there is no particular restriction on the blending ratio of the ramie fiber to the one or more additional non-water-soluble fibers, which can be determined by those skilled in the art based on requirements of specific applications.

The present invention further provides a ramie fabric produced by the above manufacturing process, in which the ramie fiber has a fineness of $160^{Nm}$ or higher, preferably $160\text{-}500^{Nm}$, and more preferably $300^{Nm}$.

In one preferred embodiment, the present invention provides a pure ramie fabric produced by the above manufacturing process, in which the ramie fiber has a fineness of $160^{Nm}$ or higher than, preferably $160\text{-}500^{Nm}$, and more preferably $300^{Nm}$.

In another preferred embodiment, the present invention provides a blended ramie fabric produced by the above manufacturing process, which can be produced by blend weaving ramie fiber having a fineness of or $160^{Nm}$ higher, preferably $160\text{-}500^{Nm}$, and more preferably $300^{Nm}$, with one or more yarns selected from yarns of cotton, hemp, wool, silk, viscose fiber, terylene fiber, polyamide fiber, acrylic fiber, urethane elastic fiber, polypropylene fiber, vinylon fiber, and aramid fiber.

In sum, one mode for carrying out the present invention mainly comprises the following steps:

(1) providing a high-count ramie fiber, such as a ramie fiber of $2500^{Nm}$ or higher;

(2) blend spinning the ramie fiber into a yarn by using a water-soluble fiber as a carrier;

(3) sizing the yarn at a low temperature; and (4) deweighting the yarn.

By combining the above steps, the present invention can achieve at least one of the following advantages: solving the technical problem of difficulty in spinning fine ramie yarn due to the poor spinnability of ramie fiber, which have puzzled the bast fiber textile industry for a long time; achieving the series and scale production of ramie fabric, especially pure ramie fabric, having a ramie yarn fineness of $160^{Nm}$ or higher, especially $160\text{-}500^{Nm}$; and producing ramie fabrics not only remaining excellent wear performance and natural style of ramie fabrics but also having few face defects thereby sufficiently overcoming the disadvantages such as breakage and weft incline usually existing in conventional ramie fabrics. As a result, the present invention facilitates sufficiently exploiting the features and values of ramie fiber material and obtaining high profit.

Based on the above combination, the present invention further provides criteria for testing and selecting ramie fiber and water-soluble fiber materials in order to manufacture a super-high-count ramie fabric, establishes process quality control criteria for respective steps, and provides criteria for testing the final product of super-high-count ramie fabric. Therefore, the present invention achieves more surprising effects.

In practice, according to the present invention, a finished fabric having very thin thickness, elegant appearance, gentle and soft feel, and good wear comfort can be obtained. For example, pure ramie fabrics of $248^{Nm}\times248^{Nm}$ and $300^{Nm}\times500^{Nm}$ can be used as preferred face fabrics of high-grade evening dresses and high-grade fashionable dresses for ladies.

SPECIFIC MODES FOR CARRYING OUT THE PRESENT INVENTION

The present invention is further described below in combination with specific embodiments, but is not limited thereto.

In the following examples, ramie fibers and water-soluble fibers were selected according to the following criteria.

1) Ramie Fiber

| | |
|---|---|
| fiber count | $2500^{Nm}$ or higher |
| breaking strength | 4.5CN/dtex or higher |
| mean fiber length | 90 mm or longer |
| 4 cm short fiber content | 3% or less |
| hard sliver ratio | 0.05% or less |
| nep | 15/2 g or less |

2) Water-Soluble Fiber

| | |
|---|---|
| fiber count | $6000^{Nm}$ or higher |
| dry breaking strength | ≥5.0 CN/dtex |
| mean fiber length | 85 mm or longer |
| 4 cm short fiber content | 10% or less |
| doubling ratio | 0.1% or less |
| dissolving temperature | ≤95° C. (completely dissolved) |

In the following examples, a stretch-breaking sliver of S-9 (II) water-soluble vinylon fiber meeting the above requirements was used as the water-soluble fiber, which had a dissolving temperature of 80-95° C. and was produced by Sichuan Vinylon Works (Sichuan Province, China); 05# ramie fiber sliver produced by Hunan Huasehng Zhuzhou Cedar Co., Ltd (Hunan Province, China) was used as the ramie fiber; and all the equipments used were purchased from Zhejiang Golden Eagle Co., (Zhejiang Province, China), unless otherwise specified.

In the following examples, the fiber contents of blended yarns for producing various fabrics were shown in table 1.

TABLE 1

Blending ratio of fibers in various yarns

| Example | Yarn count of the finished fabrics | Count of blended yarns of ramie fiber and water-soluble fiber | Content of ramie fiber, wt % | Content of water-soluble fiber, wt % |
|---|---|---|---|---|
| Ex. 1 | $160^{Nm}$ | $76^{Nm}$ | 47 | 53 |
| Ex. 2 | $248^{Nm}$ | $99^{Nm}$ | 40 | 60 |
| Ex. 3 | $300^{Nm}$ | $100^{Nm}$ | 30 | 70 |
| | $500^{Nm}$ | $150^{Nm}$ | 30 | 70 |

EXAMPLE 1

Production of $160^{Nm}\times160^{Nm}$ Bleached Super-High-Count Pure Ramie Fabric 1. The 05# ramie fiber sliver and the stretch-breaking sliver of S-9 (II) water-soluble vinylon fiber were respectively pre-drawn on a RMC type gill drawing machine to form a ramie fiber sliver with a sliver weight (dry weight) of 38.87 g/5 m and a water-soluble fiber sliver with a sliver weight (dry weight) of 31.10 g/5 m.

2. The pre-drawn ramie fiber sliver and the pre-drawn water-soluble fiber sliver in a weight ratio of 47:53 were drawn on a drawing frame for the first time to form a blended sliver. The blended sliver was drawn for the second time, the third time, and the forth time. After being drawn for many times, the two fibers in the last drawn fiber sliver were sufficiently blended to provide a uniform sliver. The drawing was conducted in a sequential manner, 4 to 5 routes were used in the drawing, the drafting rate was relatively high in the rear region, the machine speed was relatively low, the needle board beating was controlled at 450 times/min, the weight of the discharged sliver was not greater than 34 g/5 m, the total draft ratio was 8-10, and the relative humidity in the workshop was about 80%.

TABLE 2

Drawing process conditions

| Process conditions | | Drawing I | Drawing II | Drawing III | Drawing IV |
|---|---|---|---|---|---|
| Dry weight, g/5 m | | 33.95 | 30.21 | 27.27 | 24.80 |
| Total draft ratio | | 9.16 | 8.83 | 8.83 | 8.99 |
| Break draft ratio | Rear | 1.062 | 1.062 | 1.062 | 1.062 |
| | Middle | 1.000 | 1.000 | 1.000 | 1.000 |
| | Front | 1.029 | 1.029 | 1.029 | 1.029 |
| | Gilling section | 8.38 | 8.08 | 8.08 | 8.23 |
| Number of needle board beating per minute | | 411 | 411 | 411 | 411 |

Process requirements: the two fibers in the last drawn fiber silver were uniformly mixed; the weight unevenness was <1%, the saco-lowell evenness of sliver was <10%, and the weight deviation was ±2%.

3. Roving: a roving process of two routes was selected, and light weight, low speed, relatively large rear roller gauge and relatively small rear draft ratio were adopted so as to straighten the fibers in parallel. Detailed process conditions were listed in Table 3.

TABLE 3

| Process condition | Roving I | | Roving II | |
|---|---|---|---|---|
| Equipment model | CZ 411 | | CZ 421 | |
| Dry weight, g/10 m | 6.145 | | 2.667 | |
| Total draft ratio | 8.06 | | 7.50 | |
| Roller gauge, mm | front to rear | 225 | front, roller- first roller I | 55 |
| | | | first roller - second roller | 55 |
| | front to middle | 30 | second roller - third roller | 75 |
| | | | third roller - last roller | 95 |
| Speed of front roller, rpm | 130.8 | | 70.7 | |
| Spindle speed, rpm | 250 | | 500 | |

Process requirements: the total draft ratio was between 7 and 8.5; the weight of roving slivers was 6-7 g/m; the weight unevenness in the roving II was not more than 2%; the weight deviation was ±3%; the saco-lowell evenness of sliver in the roving I was <25%; and the saco-lowell evenness of sliver in the roving II was <28%.

4. Spinning

Process conditions:

| | |
|---|---|
| Equipment model | FZ501 |
| Dry weight | 1.213 g/100 m |
| Total draft ratio | 20.26 |
| Twist factor | 108 |
| Twist | 942 twists/m |
| Spindle speed | 6241 rpm |
| Front roller speed | 63.02 rpm |

5. Winding: Model 1332MD winding equipment with electronic yarn clearer and air splicer was selected for producing knotless yarn. Clearing parameters were appropriately set so that the yarn defects were effectively removed. The winding speed was lower than 350 m/min. The clearing parameters were set as follow: long thick place 90%×2.5 cm, short thick place 190%×45 cm, and long thin place −70%×45 cm.

Process requirements: the bobbin yarn was knotless, the yarn defects were thoroughly cleared; and the regenerated hairiness was reduced.

Process conditions: the linear winding speed was 372-384 m/min.

6. Warping (Equipment Model GA121)

Process requirements: uniform warp beam yarn tension and dense winding

Process conditions: smooth yarn path, warping bobbin with fixed length, collective change of bobbin, self-tightening knot, yarn tail length of 2-4 mm, and warp speed of 200 m/min Tension: nine tension regions were designated with upper, middle and lower, and front, middle and rear, and the tensions in each region was set according to yarn quality.

7. Sizing (equipment model G142D-200):

The sizing was performed by using "small tensile force, low viscosity, moderate pressure, and low speed". The used sizing solution comprised an esterified starch with medium-to-low viscosity, an amount of solid acrylic sizing agent was mixed with PVA, and a small amount of softener was added thereto, so that the sizing film was pliant and wear resistant, the yarn splitting was well, the hand feel was smooth, and the regenerated hairiness were less.

Process requirements: the sizing percentage was 4-6%; and the moisture regain was 5-7%. The sized warp was smooth, elastic, uniform in tension, and densely wound on the warp beam.

Process conditions:

| | |
|---|---|
| Sizing agent loading | 4.8-5.8% |
| Moisture regain | 3.5-5.5% |
| Speed | 40 m/min |
| Temperature in sizing box | 80° C. |
| Viscosity of sizing solution | about 7" (hanging viscosity) |

The principle components of the sizing solution: 10 g PVA, 16 g K-2000 composite modified starch, 34 g D-150A modified starch, and 3 g LMA-2050 acrylic sizing agent in per liter of the sizing solution.

8. Weaving (Equipment Model GA741)

Process requirements: clear shedding for warp, smooth weft insertion, high loom operation efficiency, and reduced fabric defects.

Process conditions:

| | |
|---|---|
| Ambient temperature | 20-28° C., humidity 80-86% |
| Loom speed | 175 rpm |
| Shed time | 280 degree |
| Shed opening | 100-105 mm |
| Heald frame height | 265 mm |
| Weft inserting time | 75 degree |

9. Finishing Gray Fabrics

Process conditions: burling and inspecting the fabrics layer by layer, and grading.

10. Turning and Sewing Up

Process conditions: accurate batching and subpackage, orderly turning, straight and firm sewing up, and edge stitching.

11. Singeing (Gas Singeing Machine)

Process requirements: fabric finish was higher than grade 3.5, without edge singeing.

Process conditions: the gray fabric was brushed on both sides with two pairs of soft hairbrushes in combination with a scraper. The singeing was performed on each side once. Wet fabrics were discharged, the machine speed was 140-160 m/min, the temperature in the gasoline gas producer was 85° C. or higher.

12. Alkali Deweighting Treatment:

Process requirements: essentially removing sizing agents and water-soluble fiber to improve the capillary effect of fabrics.

Equipments of the process: Model ASMA631 jet-overflow dyeing machine (produced by Wuxi Equipment Manufacturing Factory, Jiangsu province, China) was used.

Desizing and scrouring solution: obtained by adding sodium hydroxide of 1 g/L, sodium carbonate of 0.5 g/L, sodium sulfite of 1 g/L, non-ion surfactant Peregal-O of 0.5 g/L to clear water, and keeping at a temperature of 110-120° C. for 15 minutes.

Bath ratio: 1:20

Water washing: the gray fabric was washed with hot water of 90° C. or higher twice, each for 10 minutes, washed with cold water once, and then discharged by overflow.

13. Bleaching

Process requirements: further removing residual sizing agents, water-soluble fiber and impurities; improving the capillary effect; thoroughly removing alkali; and achieving a certain and uniform whiteness. The process conditions were listed in Table 4.

TABLE 4

| Process conditions | Unit | Bleaching | Rebleaching |
|---|---|---|---|
| Hydrogen peroxide solution (100%) | g/L | 2 | 1.5 |
| Sodium carbonate | g/L | 1.5 | 1 |
| Organic stabilizer | g/L | 1.5 | 1 |
| Penetrating agent | g/L | 0.5 | 0.5 |
| pH value | | 10 | 9.5 |
| Steaming temperature | ° C. | 95-100 | 95-100 |
| Steaming time | minutes | 40 | 40 |

Note:
the organic stabilizer was WPW-Z from Jingzhou Chemical Plant, Hubei Province, China; the penetrant was JFC from Fushun Jiahua Polyurethane Co., Ltd., Liaoning Province, China.

14. Drying

Process requirements: it was required that the discharged fabrics were flat, dry and free of overflow crease, wrinkle, blots, weft shift, and weft incline.

Process conditions: padder speed of 40 m/min, padder pressure of 2 kg/cm$^2$, clean padding trough and nip roller, clean drying cylinder, and steam pressure of 0.5 kg/cm$^2$-2 kg/cm$^2$.

15. Softening and Whitening

Process requirements: soft, smooth and comfort hand feel, white fabric, uniform whiteness, and free of wrinkle, blots, weft shift and weft incline.

Process conditions: whitening agent VBL (from Shijiazhuang Xinyu Chemical Co., Ltd, Heibei Province, China) of 1.5-2 g/L, a proper amount of softening agent, surfactant Peregal-O of 0.2 g/L, machine speed of 45 m/min, padder pressure of 2 kg/cm$^2$, twice dipping and twice padding.

16. Stentering and Setting

Process requirements: the width of wet fabrics met the process requirements (1.5-2.5 cm wider than that of the final products), had consistent width, and was free of scalloped edge, broken selvedge, pinholing, oil spots and weft shift and incline.

Process conditions: machine speed of 35-40 m/min for weft stentering.

17. Pre-shrinking

Process requirements: stabilizing the size of fabrics, reaching the desired shrinkage ratio to obtain a fabric with soft hand feel and free of wrinkles and blots.

Process conditions: machine speed of 30 m/min, and a moisture content of fabrics of 8-12% after moistening.

The steam pressure of back up roll: 0.8-1.5 kgf/cm$^2$

The gap between the back up roll and the fabric feeding roll was lower by 2-3 mm than the thickness of rubber sleeve.

The pre-shrinkage ratio of the fabrics: 2-3%

18. Fabric inspecting and taking up

The fabrics were inspected and taken up, so as to obtain the desired $160^{Nm}\times160^{Nm}$ super-high-count white ramie fabrics, which had an orderly wound edge, wrinkle-free face and clear marking, and was accurately graded.

EXAMPLE 2

Production of $248^{Nm}\times248^{Nm}$ Bleached Super-High-Count Pure Ramie Fabric 1. The 05# ramie fiber sliver and the stretch-breaking sliver of S-9 (II) water-soluble vinylon fiber were respectively pre-drawn on a RMC type gill drawing machine to form a ramie fiber sliver with a sliver weight (dry weight) of 31.10 g/5 m, and a water-soluble fiber sliver with a sliver weight (dry weight) of 31.10 g/5 m.

2. The pre-drawn ramie fiber sliver and the pre-drawn water-soluble fiber sliver in a weight ratio of 40:60 was drawn on a drawing frame for the first time to form a blended sliver. The blended sliver was then subjected to drawing for the second time, the third time, and the forth time, so that the two fibers in the last drawn fiber sliver were adequately mixed to provide a uniform sliver. The process conditions were listed in Table 5.

TABLE 5

| Drawing process conditions | | | | | |
|---|---|---|---|---|---|
| Process conditions | | Drawing I | Drawing II | Drawing III | Drawing IV |
| Dry weight, g/5 m | | 33.95 | 30.76 | 27.87 | 24.80 |
| total draft ratio | | 9.16 | 8.83 | 8.83 | 8.99 |
| Break draft ratio | Rear | 1.062 | 1.062 | 1.062 | 1.062 |
| | Middle | 1.000 | 1.000 | 1.000 | 1.000 |
| | Front | 1.029 | 1.029 | 1.029 | 1.029 |
| | Gear head | 8.38 | 8.08 | 8.08 | 8.23 |
| Number of needle board beating per minute | | 411 | 411 | 411 | 411 |

3. Roving: the process conditions were listed in Table 6.

TABLE 6

| Process condition | Roving I | | Roving II | |
|---|---|---|---|---|
| Equipment model | CZ 411 | | CZ 421 | |
| Dry weight, g/10 m | 6.185 | | 2.061 | |
| Total draft ratio | 8.02 | | 9.00 | |
| Roller gauge, mm | front to rear | 225 | front roller- first roller I | 55 |
| | | | first roller - second roller | 55 |

TABLE 6-continued

| Process condition | Roving I | | Roving II | |
|---|---|---|---|---|
| | front to middle | 30 | second roller - third roller | 75 |
| | | | third roller - last roller | 90 |
| Speed of front roller, rpm | 130.8 | | 53 | |
| Spindle speed, rpm | 250 | | 465 | |

4. Spinning (Equipment Model FZ501)

Process conditions:

| | |
|---|---|
| Dry weight | 1.031 g/100 m |
| Total draft ratio | 20 |
| Twist factor | 108 |
| Twist | 1024 twists/m |
| Spindle speed | 4458 rpm |
| Front roller speed | 38.57 rpm |

5. Winding: (Equipment Model 1332 MD)

Process conditions:

Winding speed: 326 m/min;

The clearing parameters: long thick place 300%×3.0 cm, short thick place +90%×45 cm, and long thin place −70%×45 cm.

6. Warping (Equipment Model GA121)

Process conditions:

Machine speed: 200 m/min;

Tension: nine tension regions were designated with upper, middle and lower, and front, middle and rear. The tension in each region was set according to the quality of yarns.

7. Sizing (Equipment Model G142D-200):

Process conditions:

| | |
|---|---|
| Sizing agents loading | 4-6% |
| Moisture regain | 3.5-5.5% |
| Machine speed | 40 m/min |
| Temperature in sizing box | 80° C. |
| Viscosity of sizing solution | about 8" (hanging viscosity) |

The principle components of the sizing solution: PVA of 11 g, K-2000 composite modified starch of 18 g, D-150A modified starch of 36 g, and LMA-2050 acrylic sizing agent of 3 g in per liter of the sizing solution.

8. Weaving (Equipment Model GA741)

Process conditions:

| | |
|---|---|
| Ambient temperature | 20-28° C., humidity 80-86% |
| Loom speed | 175 rpm |
| Shed time | 280 degree |
| Shed opening | 100-105 mm |
| Heald frame height | 265 mm |
| Weft inserting time | 75 degree |

9. Finishing Gray Fabrics

Process conditions: burling and inspecting the fabrics layer by layer, and grading.

10. Turning and Sewing Up

Process conditions: accurate batching and subpackage, orderly turning, straight and firm sewing up, and edge stitching 11. Singeing (gas singeing machine)

Process requirements: fabric finish was grade 4 or higher, without edge singeing.

Process conditions: the gray fabric was brushed on both sides with two pairs of soft hairbrushes in combination with a scraper. The singeing was performed on each side once. Wet fabrics were discharged, the machine speed was 160 m/min, the temperature in the gasoline gas producer was 85° C. or higher.

12. Alkali Deweighting Treatment:

Process requirements: essentially removing sizing agents and water-soluble fiber as well as impurities, and improving the capillary effect of fabrics.

Equipments for the process: Model ASMA631 jet-overflow dyeing machine (produced by Wuxi Equipment Manufacturing Factory, Jiangsu province, China) was used.

Desizing and scrouring solution: obtained by adding sodium hydroxide of 3 g/L, sodium carbonate of 1 g/L, sodium sulfite of 2 g/L, non-ion surfactant Peregal-O of 1 g/L to clear water, and keeping at a temperature of 110-120° C. for 20 minutes.

Bath ratio: 1:20

Water washing: the gray fabric was washed with hot water of 90° C. or higher twice, each for 10 minutes, washed with cold water once, and then discharged.

13. Bleaching

Process requirements: further removing residual sizing agents, water-soluble fiber and impurities; thoroughly removing alkali, improving the capillary effect, and achieving the desired and uniform whiteness. The process conditions were listed in Table 7.

TABLE 7

| Process conditions | Unit | Bleaching | Rebleaching |
|---|---|---|---|
| Hydrogen peroxide solution (100%) | g/L | 2 | 1.5 |
| Sodium carbonate | g/L | 1 | 1 |
| Organic stabilizer | g/L | 1.5 | 1.5 |
| Penetrating agent | g/L | 0.5 | 0.5 |
| pH value | | 9.5 | 10 |
| Steaming temperature | ° C. | 95-100 | 95-100 |
| Steaming time | minutes | 50 | 50 |

Note:
the organic stabilizer was WPW-Z from Jingzhou Chemical Plant, Hubei province, China; and the penetrant was JFC from Fushun Jiahua Polyurethane Co., Ltd., Liaoning province, China.

14. Drying

Process requirements: it was required that the discharged fabrics were flat, dry and free of overflow crease, wrinkles, blots, weft shift, and weft incline.

Process conditions: padder speed of 40 m/min, padder pressure of 2 kg/cm$^2$, clean padding trough and nip roller, clean drying cylinder, and steam pressure of 0.5 kg/cm$^2$-2 kg/cm$^2$.

15. Softening and Whitening

Process requirements: soft, smooth and comfort hand feel, white fabric, uniform whiteness, and free of wrinkle, blots, weft shift and weft incline.

Process conditions: whitening agent VBL of 1.5-2 g/L, a proper amount of softening agent, surfactant Peregal-O of 0.2 g/L, machine speed of 45 m/min, padder pressure of 2 kg/cm$^2$, twice dipping and twice padding.

16. Stentering and Setting

Process requirements: the width of wet fabrics met process requirements (1.5-2.5 cm wider than that of the final products), had consistent width, and was free of scalloped edge, broken selvedge, pinholing, oil spots, weft shift and incline.

Process conditions: machine speed of 35-40 m/min for weft stentering.

17. Pre-shrinking

Process requirements: stabilizing the size of fabrics, reaching the desired shrinkage ratio to obtain a fabric with soft hand feel and free of wrinkles and blots.

Process conditions: machine speed of 30 m/min, and a moisture content of fabrics of 8-12% after moistening, The steam pressure of back up roll: 0.8-1.5 kgf/cm$^2$ The gap between the back up roll and the fabric feeding roll was lower by 2-3 mm than the thickness of rubber sleeve.

The pre-shrinkage ratio of the fabrics: 2-3%.

18. Fabric Inspecting and Taking Up

The fabrics were inspected and taken up, so as to obtain the desired $248^{Nm}\times248^{Nm}$ super-high-count white ramie fabrics, which had an orderly wound edge, wrinkle-free face, and clear marking, and was accurately graded.

EXAMPLE 3

Production of $300^{Nm}\times500^{Nm}$ Bleached Super-High-Count Pure Ramie Fabric 1. The 05# ramie fiber sliver and the stretch-breaking sliver of S-9 (II) water-soluble vinylon fiber were respectively pre-drawn on a RMC type gill drawing machine to form a ramie fiber sliver with a sliver weight (dry weight) of 28.5 g/5 m, and a water-soluble fiber sliver with a sliver weight (dry weight) of 49.98 g/5 m.

2. The pre-drawn ramie fiber sliver and the pre-drawn water-soluble fiber sliver in a weight ratio of 30:70 was drawn on a drawing frame for the first time to form a blended sliver. The blended sliver was then subjected to drawing for the second time, the third time, and the forth time, so that the two fibers in the last drawn fiber sliver were adequately mixed to provide a uniform sliver. The process conditions were listed in Table 8.

TABLE 8

| Drawing process conditions | | | | | |
|---|---|---|---|---|---|
| Process conditions | | Drawing I | Drawing II | Drawing III | Drawing IV |
| Dry weight, g/5 m | | 31.12 | 28.19 | 25.54 | 22.73 |
| Total draft ratio | | 9.16 | 8.83 | 8.83 | 8.99 |
| Break draft ratio | Rear | 1.062 | 1.062 | 1.062 | 1.062 |
| | Middle | 1.0 | 1.0 | 1.0 | 1.0 |
| | Front | 1.029 | 1.029 | 1.029 | 1.029 |
| | Gear head | 8.38 | 8.08 | 8.08 | 8.23 |
| Number of needle board beating per minute | | 411 | 411 | 411 | 411 |

3. Roving: the process conditions were listed in Table 9.

TABLE 9

| Process condition | Roving I | | Roving II | |
|---|---|---|---|---|
| Equipment model | CZ 411 | | CZ 421 | |
| Dry weight, g/10 m | 5.602 | | 1.867 | |
| Total draft ratio | 8.23 | | 9.0 | |
| Roller gauge, mm | front to rear | 220 | front roller- first roller I | 55 |
| | | | first roller - second roller | 55 |
| | front to middle | 30 | second roller - third roller | 75 |
| | | | third roller - last roller | 90 |

TABLE 9-continued

| Process condition | Roving I | Roving II |
|---|---|---|
| Speed of front roller, rpm | 135 | 54.5 |
| Spindle speed, rpm | 250 | 465 |

4. Spinning (Equipment Model FZ501)

Process conditions:

| | | |
|---|---|---|
| Yarn count | $90^{Nm}$ | $150^{Nm}$ |
| Dry weight | 1.037 g/100 m | 0.622 g/100 m |
| Total draft ratio | 18.0 | 30.0 |
| Twist factor | 105 | 110 |
| Twist | 996 twists/m | 1347 twists/m |
| Spindle speed | 4458 rpm | 4458 rpm |
| Front roller speed | 40.93 rpm | 29.04 rpm |

5. Winding: (Equipment Model 1332 MD)

Process conditions:

Winding speed: 326 m/min;

The clearing parameters: long thick place +300%×3.0 cm, short thick place +90%×45 cm, and long thin place −70%×45 cm.

6. Warping (Equipment Model GA121)

Process conditions:

Machine speed: 180 m/min;

Tension: nine tension regions were designated with upper, middle and lower, and front, middle and rear. The tension in each region was set according to the quality of yarns.

7. Sizing (Equipment Model G142D-200):

Process conditions:

| | |
|---|---|
| Sizing agents loading | 4-6% |
| Moisture regain | 3.5-5.5% |
| Machine speed | 40 m/min |
| Temperature in sizing box | 80° C. |
| Viscosity of sizing solution | about 8" (hanging viscosity) |

The principle components of the sizing solution: PVA of 12 g, K-2000 composite modified starch of 17 g, D-150A modified starch of 35 g, and LMA-2050 acrylic sizing agent of 3 g in per liter of the sizing solution.

8. Weaving (Equipment Model GA741)

Process conditions:

| | |
|---|---|
| Ambient temperature | 20-28° C., humidity 80-86% |
| Loom speed | 175 rpm |
| Shed time | 280 degree |
| Shed opening | 100 mm |
| Heald frame height | 265 mm |
| Weft inserting time | 75 degree |

9. Finishing Gray Fabrics

Process conditions: burling and inspecting the fabrics layer by layer, and grading.

10. Turning and Sewing Up

Process conditions: accurate batching and subpackage, orderly turning, straight and firm sewing up, and edge stitching.

11. Singeing (Gas Singeing Machine)

Process requirements: fabric finish was grade 4 or higher.

Process conditions: the gray fabric was brushed on both sides with two pairs of soft hairbrushes in combination with a scraper. The singeing was performed on each side once. Wet fabrics were discharged, the machine speed was 150 m/min, the temperature in the gasoline gas producer was 85° C. or higher.

12. Alkali Deweighting Treatment:

Process requirements: essentially removing sizing agents and water-soluble fiber as well as impurities, and improving the capillary effect of fabrics.

Equipments for the process: Model ASMA631 jet-overflow dyeing machine (produced by Wuxi Equipment Manufacturing Factory, Jiangsu province, China) was used.

Desizing and scrouring solution: obtained by adding sodium hydroxide of 3 g/L, sodium carbonate of 1 g/L, sodium sulfite of 2 g/L, non-ion surfactant Peregal-O 1 g/L to clear water, and keeping at a temperature of 110-120° C. for 20 minutes.

Bath ratio: 1:20

Water washing: gray fabric was washed with hot water of 90° C. or higher twice, each for 10 minutes, washed with cold water once, and then discharged.

13. Bleaching

Process requirements: further removing residual sizing agents, water-soluble fiber and impurities; thoroughly removing alkali, improving the capillary effect, and achieving the desired and uniform whiteness. The process conditions were listed in Table 10.

| Process conditions | Unit | Bleaching | Rebleaching |
|---|---|---|---|
| Hydrogen peroxide solution (100%) | g/L | 1.5 | 1.0 |
| Sodium carbonate | g/L | 1 | 1 |
| Organic stabilizer | g/L | 1.5 | 1.5 |
| Penetrating agent | g/L | 0.5 | 0.5 |
| pH value | | 9.5 | 10 |
| Steaming temperature | ° C. | 95-100 | 95-100 |
| Steaming time | minutes | 50 | 50 |

Note:

the organic stabilizer was WPW-Z from Jingzhou Chemical Plant, Hubei province, China; and the penetrant was JFC from Fushun Jiahua Polyurethane Co., Ltd., Liaoning province, China.

14. Drying

Process requirements: it was required that the discharged fabrics were flat, dry and free of overflow crease, wrinkles, blots, weft shift, and weft incline.

Process conditions: padder speed of 40 m/min, padder pressure of 2 kg/cm$^2$, clean padding trough and nip roller, clean drying cylinder, and steam pressure of 0.5 kg/cm$^2$-2 kg/cm$^2$.

15. Softening and Whitening

Process requirements: soft, smooth and comfort hand feel, white fabric, uniform whiteness, and free of wrinkle, blots, weft shift and weft incline.

Process conditions: whitening agent VBL of 1.5-2 g/L, a proper amount of softening agent, surfactant Peregal-O of 0.2 g/L, machine speed of 45 m/min, padder pressure of 2 kg/cm$^2$, twice dipping and twice padding.

16. Stentering and Setting

Process requirements: the width of wet fabrics met process requirements (1.5-2.5 cm wider than that of the final products), had consistent width, and was free of scalloped edge, broken selvedge, pinholing, oil spots, weft shift and incline.

Process conditions: machine speed of 30-35 m/min for weft stentering.

17. Pre-shrinking

Process requirements: stabilizing the size of fabrics, reaching the desired shrinkage ratio to obtain a fabric with soft hand feel and free of wrinkles and blots.

Process conditions: machine speed of 30 in/min, and a moisture content of fabrics of 8-12% after moistening, The steam pressure of back up roll: 0.8-1.5 kgf/cm$^2$ The gap between the back up roll and the fabric feeding roll was lower by 2-3 mm than the thickness of rubber sleeve.

The pre-shrinkage ratio of the fabrics: 2-3%.

18. Fabric inspecting and taking up

The fabrics were inspected and taken up, so as to obtain the desired $300^{Nm}\times500^{Nm}$ super-high-count white ramie fabrics, which had an orderly wound edge, wrinkle-free face, and clear marking, and was accurately graded.

What is claimed is:

1. A process for manufacturing a ramie fabric, including the following steps:

blend spinning a ramie fiber of $2500^{Nm}$ or higher by using a water-soluble fiber as a carrier to form a yarn, the water-soluble fiber is of $6000^{Nm}$ or higher;

sizing the yarn at a low temperature and then weaving the yarn into a gray fabric;

removing the water-soluble fiber from the gray fabric by deweighting the gray fabric during a printing and dyeing finishing process to obtain a ramie fabric with a ramie yarn fineness of $160^{Nm}$ or higher; and wherein the printing and dyeing finishing process comprises the steps of turning and sewing up, then singeing, then deweighting, then bleaching, whitening and softening, stentering, and winding, and the step of deweighting comprises using an alkali desizing and scouring solution in a jet-overflow dyeing machine to thoroughly remove the sizing agents and the water-soluble fiber.

2. The process according to claim 1, wherein the water-soluble fiber is between about $6000^{Nm}$-$8000^{Nm}$.

3. The process according to claim 1, wherein the water-soluble fiber has a water-dissolving temperature of 95° C. or lower.

4. The process according to claim 1, wherein the step of blend spinning the ramie fiber with the water-soluble fiber as carrier comprises subjecting the water-soluble fiber and the ramie fiber to the steps of pre-drawing, drawing, roving and spinning to obtain a blended yarn of the ramie fiber and the water-soluble fiber.

5. The process according to claim 4, wherein the dry-weight blending ratio of the ramie fiber to the water-soluble fiber in the blended yarn is 20-70:80-30.

6. The process according to claim 4, wherein the step of drawing is performed by drawing the pre-drawn water-soluble fiber and the pre-drawn ramie fiber for at least 4 times, using a drawing process with 4 or more routes, and adopting a total draft ratio of 8-10.

7. The process according to claim 4, wherein the step of roving is performed by using a roving process with two routes and adopting a total draft ratio of 7-9.5.

8. The process according to claim 4, wherein the step of spinning is performed by adopting a total draft ratio of 10-40, a twist factor of 100-130, and a twist degree of 800-1200 twist/m.

9. The process according to claim 1, wherein the step of sizing the yarn at low temperature is performed at a temperature of 95° C. or lower.

10. The process according to claim 1, wherein the step of sizing the yarn at low temperature is performed by using a sizing solution comprising a polyvinyl alcohol, a modified starch and an acrylic sizing agent.

11. The process according to claim 10, wherein the step of sizing the yarn at low temperature is performed by using a sizing solution comprising a polyvinyl alcohol of 5-20 g/L, a composite multi-component modified starch of 10-25 g/L, an oxidized starch of 30-40 g/L, and an acrylic sizing agent of 1-8 g/L.

12. The process according to claim 1, wherein the step of deweighting comprises placing the singed fabric in a jet-overflow dyeing machine, heating to a temperature of 110-120° C., keeping the temperature for 15-20 minutes, washing the fabric in a bath of an alkali desizing and scouring solution, discharging the fabric, washing with hot water of 90° C. or higher twice, each for 10 minutes, and washing with cold water once.

13. The process according to claim 1, wherein the alkali desizing and scouring solution comprises sodium hydroxide of 1-5 g/L, sodium carbonate of 0.2-1.5 g/L, sodium sulfite of 1-5 g/L and non-ion surfactant Peregal-O 0.2-1.5 g/L, relative to per liter of clear water.

14. The process according to claim 1, wherein the bath ratio of the alkali desizing and scouring solution is 1:20.

15. The process according to claim 1, wherein the water-soluble fiber is one or more water-soluble fibers selected from vinylon fiber, alginate fiber and carboxymethylcellulose fiber.

16. The process according to claim 1, wherein after the step of blend spinning the ramie fiber and the water-soluble fiber as carrier to form the yarn, the blended yarn is further blend spun with one or more additional non-water-soluble fibers and then woven into a gray fabric.

17. The process according to claim 16, wherein the additional non-water-soluble fibers comprise one or more fibers selected from cotton fiber, hemp fiber, wool fiber, silk fiber, viscose fiber, polyester fiber, polyamide fiber, acrylic fiber, polyurethane fiber, polypropylene fiber, polyvinyl alcohol fiber and aramid fiber.

18. The process according to claim 1, wherein the water-soluble fiber is unacetalized vinylon fiber.

* * * * *